US005781930A

United States Patent [19]

Boshoff

[11] Patent Number: 5,781,930

[45] Date of Patent: Jul. 21, 1998

[54] JACKET WITH SAILS SITUTATED BENEATH ASSOCIATED SLEEVES

[76] Inventor: Alton L. Boshoff, 110 30 St., Newport Beach, Calif. 92663

[21] Appl. No.: 751,576

[22] Filed: Nov. 18, 1996

[51] Int. Cl.[6] ..... A41D 1/02

[52] U.S. Cl. ..... 2/93; 2/69; 2/108

[58] Field of Search ..... 2/93, 69, 70, 85, 2/88, 94, 102, 108, 105, 106, 115, 79, 80, 84; 441/102; 482/105; 383/4

[56] References Cited

U.S. PATENT DOCUMENTS

| | | | |
|---|---|---|---|
| D. 310,596 | 9/1990 | Burger | D2/741 |
| D. 351,493 | 10/1994 | DeCinque | D2/741 |
| 766,613 | 8/1904 | Greene | 2/105 |
| 2,005,460 | 6/1935 | Fried | 441/102 |
| 4,220,299 | 9/1980 | Motter | 2/84 |
| 4,854,572 | 8/1989 | Knight | 482/105 |
| 5,176,600 | 1/1993 | Wilkinson | 482/105 |

FOREIGN PATENT DOCUMENTS

| | | | |
|---|---|---|---|
| 1434108 | 2/1966 | France | 2/94 |

OTHER PUBLICATIONS

The Sears Wish Book 1980 Catalog pp. 34–35, Jackets items 8.

*Primary Examiner*—Gloria Hale

[57] ABSTRACT

A jacket with sails situated beneath associated sleeves including a jacket having a torso portion with a front, a back, an open top, an open bottom, and a pair of sides. The jacket further has a pair of sleeves coupled at inboard ends thereof to the sides adjacent the open top thereof. A pair of vertically oriented elongated thin pockets each extend between the open bottom of the jacket and an intersection of an associated sleeve and the torso portion. Further provided are a pair of wings each with a first side edge coupled within the pocket along a length thereof. Each wing further has a second side edge coupleable to an adjacent sleeve. In use, the wings have a stored orientation within the pockets and an employed orientation with the second side edge coupled to the associated sleeve.

1 Claim, 4 Drawing Sheets

JACKET WITH SAILS SITUATED BENEATH ASSOCIATED SLEEVES

BACKGROUND OF THE INVENTION

1. Field of the Invention

The present invention relates to a jacket with sails situated beneath associated sleeves and more particularly pertains to utilizing wind to a user's advantage during recreational activities with a pair of wings capable of being stored when not in use.

2. Description of the Prior Art

The use of air resistance exercise apparel is known in the prior art. More specifically, air resistance exercise apparel heretofore devised and utilized for the purpose of enhancing exercise are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,176,600 to Wilkinson; U.S. Pat. No. 4,220,299 to Motter; U.S. Pat. Des. No. 310,596 to Burger; U.S. Pat. No. 4,531,763 to Toland; U.S. Pat. No. 4,854,572 to Knight; and U.S. Pat. No. 4,527,794 to Dunn.

In this respect, the jacket with sails situated beneath associated sleeves according to the present invention substantially departs from the conventional concepts and designs of the prior art, and in so doing provides an apparatus primarily developed for the purpose of utilizing wind to a user's advantage during recreational activities with a pair of wings capable of being stored when not in use.

Therefore, it can be appreciated that there exists a continuing need for a new and improved jacket with sails situated beneath associated sleeves which can be used for utilizing wind to a user's advantage during recreational activities with a pair of wings capable of being stored when not in use. In this regard, the present invention substantially fulfills this need.

SUMMARY OF THE INVENTION

In view of the foregoing disadvantages inherent in the known types of air resistance exercise suits now present in the prior art, the present invention provides an improved jacket with sails situated beneath associated sleeves. As such, the general purpose of the present invention, which will be described subsequently in greater detail, is to provide a new and improved jacket with sails situated beneath associated sleeves which has all the advantages of the prior art and none of the disadvantages.

To attain this, the present invention essentially comprises a jacket having a torso portion with a front, a back, an open top, an open bottom, and a pair of sides. The open bottom has an elastic band coupled to a periphery thereof. For allowing the jacket to be selectively worn by a user, the front has a vertically oriented zipper. The jacket further includes a pair of sleeves coupled at inboard ends thereof to the sides adjacent the open top thereof. The sleeves each further have an open outboard end with elastic coupled to a periphery thereof. A row of zipper tabs extend along a lower surface of each sleeve between the open outboard end thereof and an intersection of the sleeve and the torso portion. Further provided is a pair of vertically oriented elongated thin pockets. Each pocket extends between the open bottom of the jacket and the intersection of an associated sleeve and the torso portion. The pockets each also have a row of zipper tabs situated on opposite vertical side edges thereof. A zipper is adapted to interlock the rows of zipper tabs by the upwardly sliding thereof. A pair of wings are provided each with a generally triangular configuration. Each wing has a bottom edge having elastic coupled along the length thereof. A first side edge of each wing is stitchedly coupled within the pocket along a length thereof. Each wing further has a second side edge with a row of zipper tabs formed along the length thereof. A zipper is slidably situated on the row of zipper tabs. In use, the wings have a stored orientation within the pockets. See FIG. 6. The wings also have an employed orientation with the row of zipper tabs thereof coupled to the row of zipper tabs of the associated sleeve, as shown in FIGS. 1 & 2.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jacket with sails situated beneath associated sleeves which has all the advantages of the prior art air resistance exercise suits and none of the disadvantages.

It is another object of the present invention to provide a new and improved jacket with sails situated beneath associated sleeves which may be easily and efficiently manufactured and marketed.

It is a further object of the present invention to provide a new and improved jacket with sails situated beneath associated sleeves which is of a durable and reliable construction.

An even further object of the present invention is to provide a new and improved jacket with sails situated beneath associated sleeves which is susceptible of a low cost of manufacture with regard to both materials and labor, and which accordingly is then susceptible of low prices of sale to the consuming public, thereby making such jacket with sails situated beneath associated sleeves economically available to the buying public.

Still yet another object of the present invention is to provide a new and improved jacket with sails situated beneath associated sleeves which provides in the apparatuses and methods of the prior art some of the advantages thereof, while simultaneously overcoming some of the disadvantages normally associated therewith.

Still another object of the present invention is to utilize wind to a user's advantage during recreational activities with a pair of wings capable of being stored when not in use.

Lastly, it is an object of the present invention to provide a new and improved jacket with sails situated beneath associated sleeves including a jacket having a torso portion with a front, a back, an open top, an open bottom, and a pair of sides. The jacket further has a pair of sleeves coupled at inboard ends thereof to the sides adjacent the open top thereof. A pair of vertically oriented elongated thin pockets each extend between the open bottom of the jacket and an intersection of an associated sleeve and the torso portion. Further provided are a pair of wings each with a first side edge coupled within the pocket along a length thereof. Each wing further has a second side edge coupleable to an adjacent sleeve. In use, the wings have a stored orientation within the pockets and an employed orientation with the second side edge coupled to the associated sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
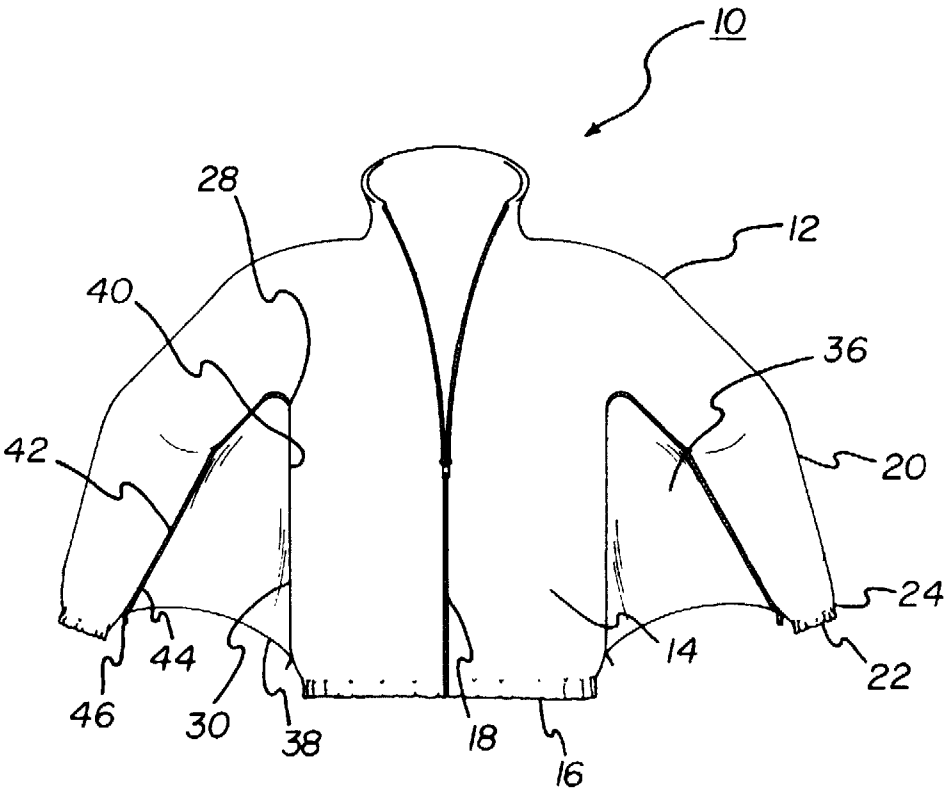
FIG. 1 is an illustration of the preferred embodiment of the jacket with sails situated beneath associated sleeves constructed in accordance with the principles of the present invention.
Figure 4:
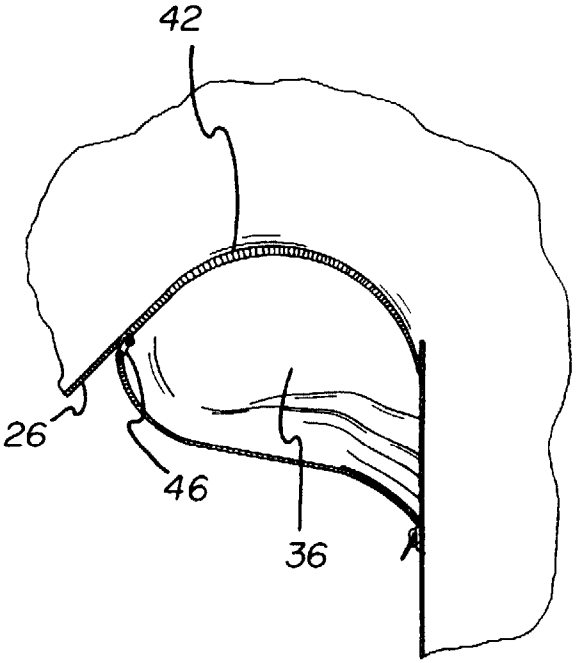
FIG. 4 is a close-up view of one of the wings.
Figure 3:
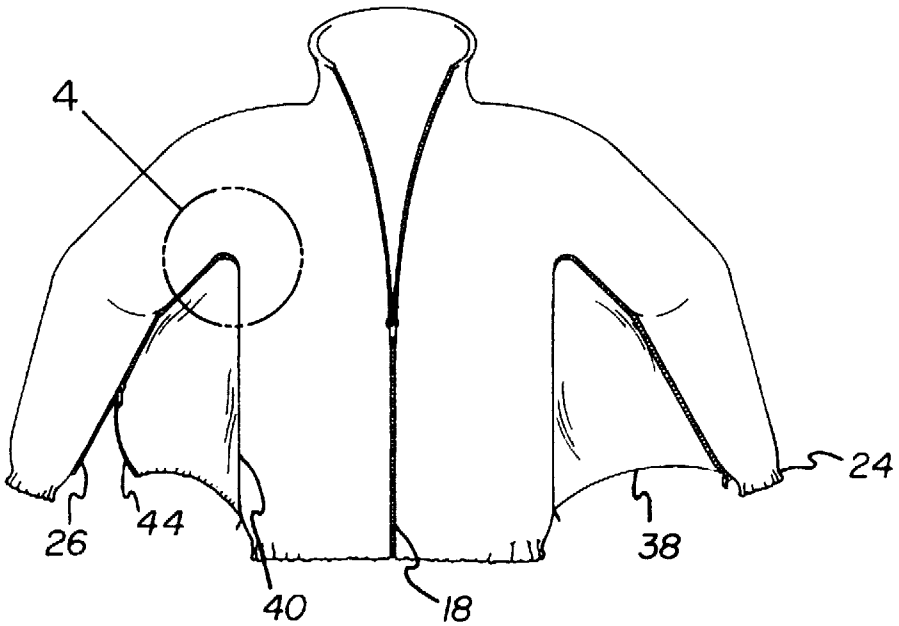
FIG. 3 is a front elevational view showing the detachable nature of the second side edge of the wings.

With reference now to the drawings, and in particular to FIG. 1 thereof, a new and improved jacket with sails situated beneath associated sleeves embodying the principles and concepts of the present invention and generally designated by the reference numeral 10 will be described.

The present invention, the new and improved jacket with sails situated beneath associated sleeves, is comprised of a plurality of components. Such components in their broadest context include a jacket, a pair of pockets, and a pair of wings. Such components are individually configured and correlated with respect to each other so as to attain the desired objective.

More specifically, it will be noted that the system 10 of the present invention includes a jacket 12 having a torso portion 14 with a front, a back, an open top, an open bottom, and a pair of sides. Ideally, the jacket is constructed from a wind impermeable material such as nylon. The open bottom has an elastic band 16 coupled to a periphery thereof. For allowing the jacket to be selectively worn by a user, the front has a vertically oriented zipper 18. The jacket further includes a pair of sleeves 20 coupled at inboard ends thereof to the sides adjacent the open top of the torso portion thereof. The sleeves each further have an open outboard end 22 with elastic 24 coupled to a periphery thereof. A row of zipper tabs 26 extend along a lower surface of each sleeve approximately between the open outboard end thereof and an intersection 28 of the sleeve and the torso portion.

Further provided is a pair of vertically oriented elongated thin pockets 30. Each pocket extends between the open bottom of the jacket and the intersection of an associated sleeve and the torso portion. The pockets each also have a row of zipper tabs 32 situated on opposite vertical side edges thereof. A zipper 34 is adapted to interlock the rows of zipper tabs by the upwardly sliding thereof.

Figure 2:
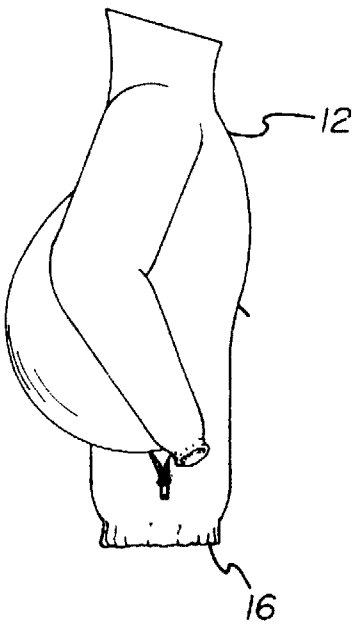
FIG. 2 is a side view of the jacket with the wings thereof in the employed orientation.
Figure 6:
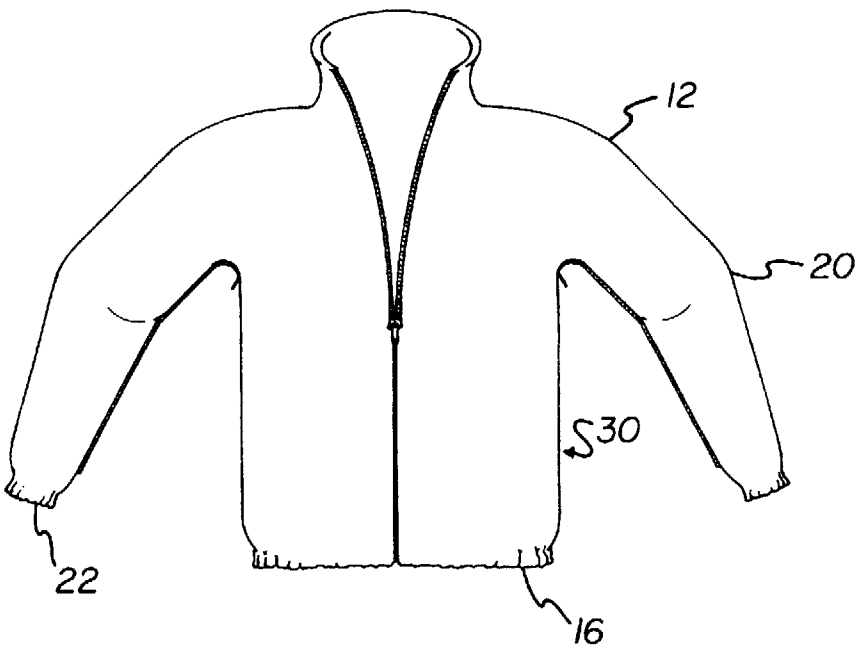
FIG. 6 is a front elevational view of the wings in the stored orientation thereof.
Figure 5:
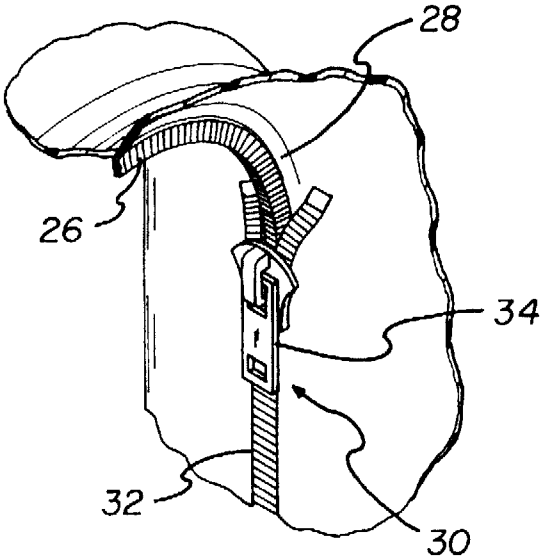
FIG. 5 is yet another close-up view showing one of the wings in the stored orientation thereof.

A pair of wings 36 are each provided with a generally triangular configuration. Each wing has a bottom edge 38 having elastic coupled along the length thereof. A first side edge 40 of each wing is stitchedly coupled within the pocket along a length thereof. Each wing further has a second side edge 42 with a row of zipper tabs 44 formed along the length thereof. Preferably, the row of zipper tabs 26 extend to a top end of the first side edge of an associated wing. A zipper 46 is slidably situated on the row of zipper tabs 44. In use, the wings have a stored orientation within the pockets. See FIG. 6. The wings also have an employed orientation with the row of zipper tabs thereof coupled to the row of zipper tabs of the associated sleeve, as shown in FIGS. 1 & 2. It should be noted that in such employed orientation, the elastic serves to preclude the flapping of the wings. Also, when the sleeves are held within a vertical plane and 45 degrees below the horizontal, the wings each define a well of approximately 6 inches. To obtain this, the first and second side edges of the wings are approximately 2 feet in length and the bottom edge is 3 and ½ feet in length.

Figure 7:
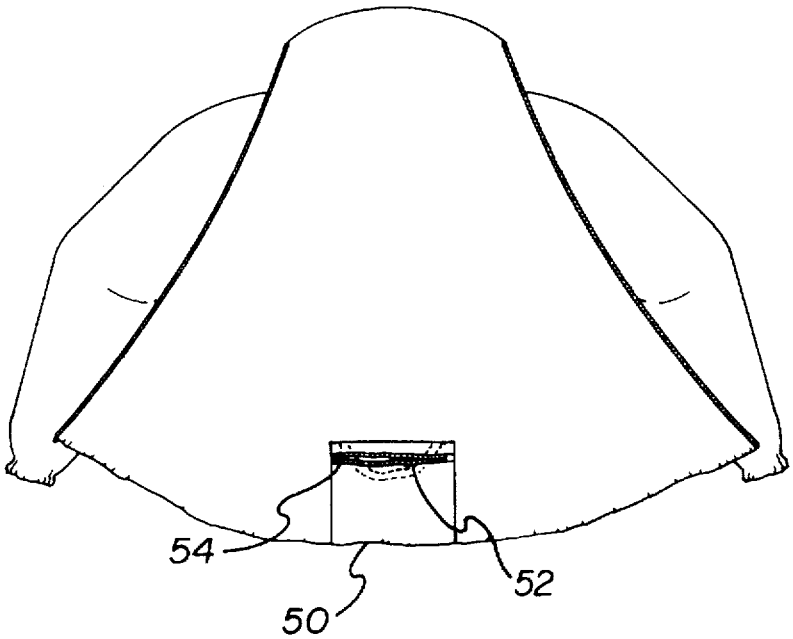
FIG. 7 is front elevational view of an optional pocket of the present invention.
Figure 8:
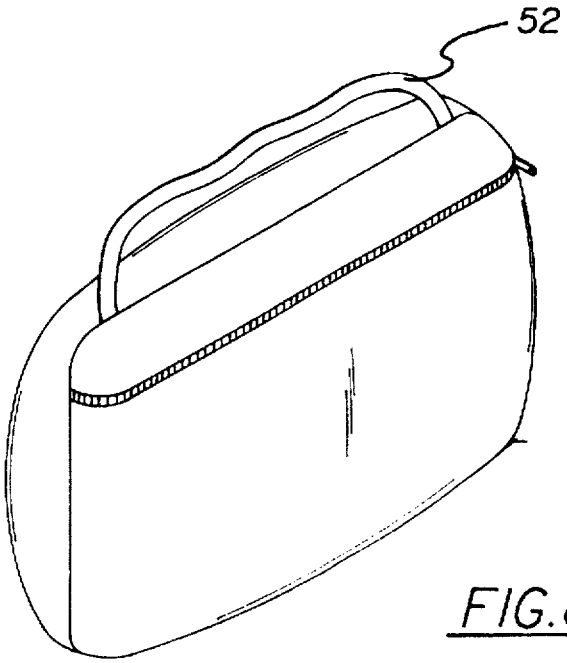
FIG. 8 is a perspective view of the jacket shown in FIG. 7 stored in the optional pocket.

Optionally, as shown in FIGS. 7 & 8, a rectangular pocket 50 with an open top edge is situated on the back of the jacket adjacent the open bottom edge thereof. Ideally, the pocket resides within the interior of the jacket. The pocket further has a handle 52 with ends attached to opposite sides of the open top edge thereof. Additionally, a zipper 54 is provided to seal the open top edge of the pocket. When the pocket is utilized, the jacket may be stored therein and the zipper subsequently sealed such that the jacket may be totted by the handle thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jacket with sails situated beneath associated sleeves comprising, in combination:

a nylon jacket having a torso portion with a front, a back, an open top, an open bottom, and a pair of sides, the open bottom having an elastic band coupled to a periphery thereof, the front having a vertically oriented zipper for allowing the jacket to be selectively worn by a user, the jacket further having a pair of sleeves coupled at inboard ends thereof to the sides adjacent the open top thereof, the sleeves each further having an open outboard end with elastic coupled to a periphery thereof and a row of zipper tabs extending along a lower surface thereof between the open outboard end thereof and an intersection of the sleeve and the torso portion;

a pair of vertically oriented elongated thin pockets each extending between the open bottom of the jacket and the intersection of an associated sleeve and the torso portion, the pockets each also having a row of zipper tabs situated on opposite vertical side edges thereof with a zipper adapted to interlock the rows of zipper tabs by the upwardly sliding thereof;

a pair of wings each with a generally triangular configuration with a bottom edge having elastic coupled along the length thereof, a first side edge stitchedly coupled within the pocket along a length thereof, a second side edge with a row of zipper tabs with a zipper slidably situated thereon which extend to a top end of the first side edge of an associated wing, the wings having a stored orientation within the pockets and an employed orientation with the row of zipper tabs thereof coupled to the row of zipper tabs of the associated sleeve, wherein each wing defines a 6-inch deep well when the sleeves are held within a vertical plane and 45 degrees below the horizontal with the sleeves having a first and second side edge each with a length of 2 feet and a bottom edge with a length of 3 and ½ feet; and a rectangular pocket with an open top edge situated on the back of the jacket adjacent the open bottom thereof and within an interior thereof, the pocket including a zipper for sealing the open top edge thereof and a handle for totting the jacket, whereby the pocket is adapted to store the jacket therein.

* * * * *